US006490554B2

(12) United States Patent
Endo et al.

(10) Patent No.: US 6,490,554 B2
(45) Date of Patent: Dec. 3, 2002

(54) SPEECH DETECTING DEVICE AND SPEECH DETECTING METHOD

(75) Inventors: Kaori Endo; Yasuji Ota, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/112,470

(22) Filed: Mar. 28, 2002

(65) Prior Publication Data

US 2002/0138255 A1 Sep. 26, 2002

Related U.S. Application Data

(63) Continuation of application No. PCT/JP99/06539, filed on Nov. 24, 1999.

(51) Int. Cl.[7] ..... G10L 11/02
(52) U.S. Cl. ..... 704/215; 704/228
(58) Field of Search ..... 704/206, 208, 704/210, 213, 214, 215, 226, 228

(56) References Cited

U.S. PATENT DOCUMENTS 5,509,102 A * 4/1996 Sasaki ..... 704/212
5,649,055 A * 7/1997 Gupta et al. ..... 704/208
5,963,901 A * 10/1999 Vahatalo et al. ..... 704/218
6,104,993 A * 8/2000 Ashley ..... 381/94.1
6,122,610 A * 9/2000 Isabelle ..... 381/94.2
6,154,721 A * 11/2000 Sonnic ..... 704/213
6,202,046 B1 * 3/2001 Oshikiri et al. ..... 704/226
6,321,194 B1 * 11/2001 Berestesky ..... 704/232

* cited by examiner

*Primary Examiner*—Marsha D. Banks-Harold
*Assistant Examiner*—Martin Lerner
(74) *Attorney, Agent, or Firm*—Katten Muchin Zavis Rosenman

(57) ABSTRACT

The invention relates to a voice activity detecting device and a voice activity detecting method. An object of the invention is to adapt to various characteristics of noise which may possibly be superimposed on an aural signal to thereby reliably discriminate between an active voice segment and a non-active voice segment. For this purpose, the voice activity detecting device comprises: a speech-segment inferring section 11 for determining the probability that each of active voice frames given in order of time sequence belongs to the active voice segment, based on the statistical characteristic of the aural signal; a quality monitoring section 12 for monitoring the quality of the aural signal for each active voice frame, and a speech-segment determining section 13 for weighting the determined probability with the above quality to obtain for each active voice frame the accuracy that the active voice frame belongs to the active voice segment.

33 Claims, 12 Drawing Sheets

PRIOR ART FIG. 12
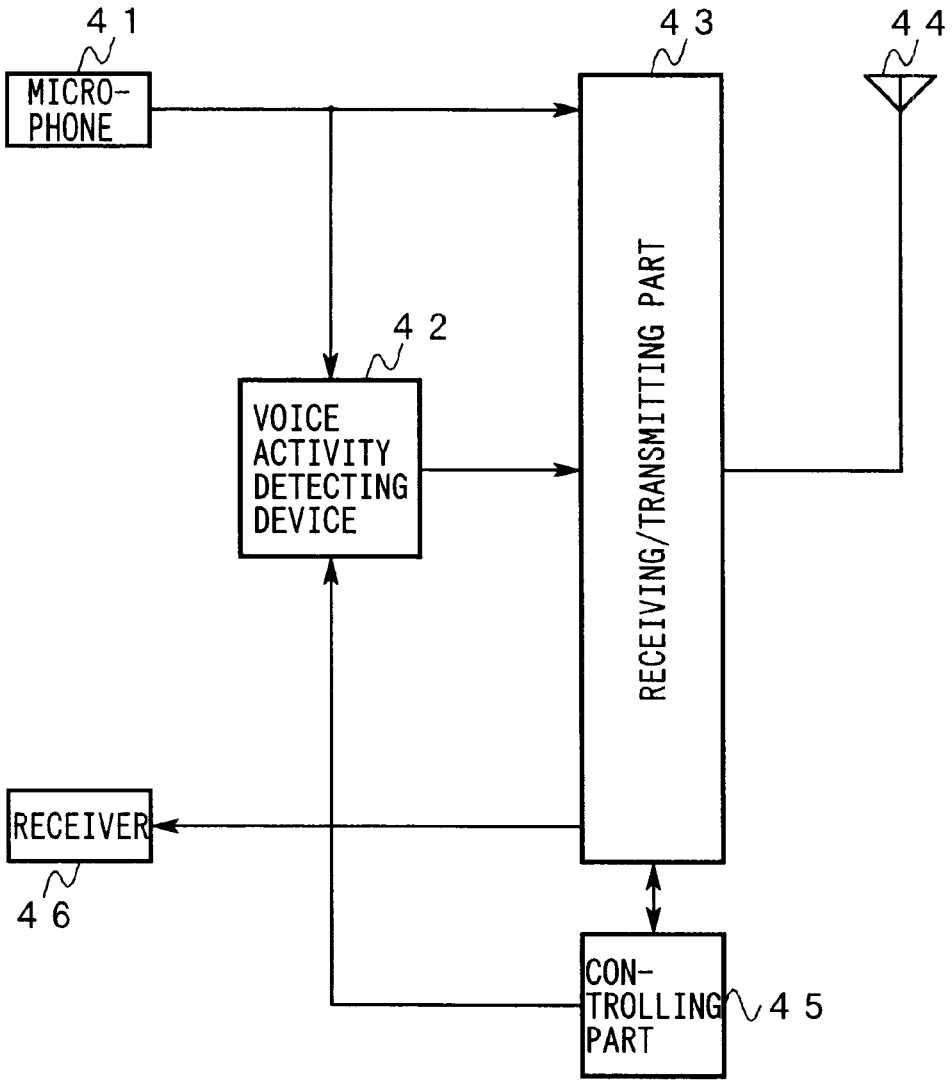

SPEECH DETECTING DEVICE AND SPEECH DETECTING METHOD

CROSS REFERENCE TO RELATED APPLICATION

This application is a continuation application of International Application PCT/JP99/06539, filed Nov. 24, 1999, and designating the U.S.

BACKGROUND OF INVENTION

1. Field of the Invention

The present invention relates to a voice activity detecting device for discriminating between an active voice segment and a non-active voice segment of the aural signal, and it also relates to a voice activity detecting method which is applied to the voice activity detecting device.

2. Description of the Related Art

In recent years, digital signal processing technologies have been highly progressed, and in a mobile communication system and other communication systems, these digital signal processing technologies are applied to perform various kinds of real time signal processing for an aural signal which is transmission information.

Furthermore, at a transmitting end of a communication system like the above, a voice activity detecting device for detecting an active voice segment and a non-active voice segment of the aforesaid aural signal and for allowing transmission to a transmission channel only in this active voice segment is mounted for the purpose of achieving compression of a transmission band and effective utilization of a radio frequency and saving power consumption.

FIG. 12 is a block diagram showing a configuration example of a radio terminal equipment in which the voice activity detecting device is mounted.

In FIG. 12, a microphone 41 is connected to an input of a voice activity detecting device 42 and a modulation input of a receiving/transmitting part 43, and a feeding point of an antenna 44 is connected to an antenna terminal of this receiving/transmitting part 43. An output of the voice activity detecting device 42 is connected to a transmission control input of the receiving/transmitting part 43, and to a control input/output of this receiving/transmitting part 43, a corresponding input/output port of a controlling part 45 is connected. A specific output port of the controlling part 45 is connected to a control input of the voice activity detecting device 42 and a demodulation output of the receiving/transmitting part 43 is connected to an input of a receiver 46.

In the radio terminal equipment as configured above, the receiving/transmitting part 43 radio-interfaces aural signals, which are transmission information to be transmitted/received via the microphone 41 and the receiver 46, with a radio transmission channel (not shown) which is accessible via the antenna 44.

The controlling part 45 plays a leading role in channel control which is required for forming this radio transmission channel by operating in association with the receiving/transmitting part 43.

The voice activity detecting device 42 samples the aforesaid aural signals at a predetermined cycle to generate a sequence of active voice frames. Moreover, the voice activity detecting device 42 discriminates, based on the characteristic of the aural signal, which of an active voice segment and a non-active voice segment each of the active voice frames corresponds to, and outputs a binary signal indicating the result of the discrimination.

Note that the aforesaid characteristic includes, for example, the following items. having a dynamic range of approximately 55 decibel Amplitude distribution can be approximated to by a standard probability density function. Values of energy density and a zero crossing frequency in the active voice segment are different from those in the non-active voice segment respectively.

The receiving/transmitting part 43 refrains from transmitting during a period when a logical value of the binary signal indicates the aforesaid non-active voice segment.

Therefore, unwanted transmission by the receiving/transmission part 43 is restricted during a period when any available information is not included as transmission information in the aural signal. Consequently, suppression of interference with other radio channel and effective utilization of a radio frequency as well as reduction in power consumption can be realized.

In the conventional example as described above, however, a difference in a feature value (for example, the aforesaid zero crossing frequency) between in the active voice segment and in the non-active voice segment becomes small during a period when noise of a high level is superimposed on the aural signal which is given via the microphone 41.

Furthermore, even in the active voice segment, amplitude of the aural signal is generally distributed more at small values compared with that in a vowel segment when it is a consonant segment.

Therefore, it is highly possible that the consonant segment is discriminated as the non-active voice segment, so that a corresponding active voice frame is not transmitted in the consonant (active voice) segment which has been mistakenly discriminated as explained above, which is very likely to cause unwanted deterioration in speech quality.

Furthermore, when the level of the aforesaid noise is excessively high, there is a possibility that transmission of the whole active voice frame which corresponds to most part of the aural signal on which the noise is superimposed is restricted.

Incidentally, these problems can be solved, for example, when a threshold value for the feature value or the like which serves as the basis of the discrimination is set at such a value to cause the active voice frame to be easily discriminated as the active voice segment.

When the threshold value as mentioned above is applied, however, the probability is increased that the active voice frame is discriminated as the active voice segment even though it corresponds to the non-active voice segment and an hour rate of the active voice segment may possibly become excessively high, so that there is a possibility that reduction in power consumption, suppression of interference, and effective utilization of a radio frequency as stated above cannot be fully realized.

SUMMARY OF THE INVENTION

It is an object of the present invention to provide a voice activity detecting device which is flexibly adaptable to various features of an aural signal and to noise be superimposed on the aural signal and is capable of discriminating between an active voice segment and a non-active voice segment with high accuracy, and also to provide a voice activity detecting method.

It is another object of the present invention that even when an active voice segment includes many segments such as a consonant segment in which the quality of an aural signal is low because of its low amplitude, the segments are determined as a part of an active voice segment with high reliability.

It is still another object of the present invention to determine each active voice frame as a part of an active voice segment with high accuracy.

It is yet another object of the present invention to reduce required throughput or enhance responsiveness.

It is yet another object of the present invention to determine even active voice frames having noise of a high level superimposed on and a low SN ratio as a part of an active voice segment with high accuracy.

It is yet another object of the present invention that communication equipments and other electronic equipments to which the invention is applied, are able to flexibly adapt to an acoustic environment in which an acousto-electric converting section for generating an aural signal is disposed, or to a characteristic and performance of an information source of the active voice signal, and they are able to discriminate between an active voice segment and a non-active voice segment of this aural signal with high reliability so that desired performance suitable for the discrimination result and effective utilization of resources can be achieved.

The above-described objects are achieved by a voice activity detecting device and a voice activity detecting method which are characterized in that a probability that an active voice frame belongs to an active voice segment, and the quality of the active voice frame are determined on an active-voice-frame basis, and the probability is weighted with the quality to output the resultant.

According to the voice activity detecting device and the voice activity detecting method as structured above, the higher quality each of the active voice frames has, with higher probability discriminated it is as the active voice segment and also with lower probability discriminated it is as a non-active voice segment.

The above-described objects are also achieved by a voice activity detecting device and a voice activity detecting method which are characterized in that a probability that an active voice frame belongs to an active voice segment, and the quality of the active voice frame are determined on an active-voice-frame basis so that the level of the active voice frame for which the probability is to be determined is set at a lower value as an active voice frame has higher quality.

According to the voice activity detecting device and the voice activity detecting method as structured above, since a heavier weighting is given to instantaneous values of the aural signal included in each of the active voice frames as the active voice frame has lower quality, it is possible to determine, at a large value, an accuracy that the resulting aural signal given as a sequence of instantaneous values belongs to the active voice segment.

The above-described objects are also achieved by a voice activity detecting device and a voice activity detecting method which are characterized in that a probability that an active voice frame belongs to an active voice segment and the quality of the active voice frame are determined on an active-voice-frame basis so that a gradient in or a threshold value of a companding characteristic is set at a larger value as the active voice frame has higher quality, the companding characteristic being to be applied to companding processing of the active voice frame for which the probability is to be determined.

According to the voice activity detecting device and the voice activity detecting method as structured above, the companding processing is performed such that the lower quality an aural signal has, the more heavily weighted instantaneous values of the aural signal included in each of the active voice frames are.

The above-described objects are also achieved by a voice activity detecting device which is characterized in that a feature of an active voice segment and/or a feature of a non-active voice segment is/are determined for each active voice frame, and these features are employed as quality.

According to the voice activity detecting device as structured above, it is possible to obtain the quality of an aural signal with stability under application of various technologies which realize active voice analysis or speech analysis.

The above-described objects are also achieved by a voice activity detecting device and a voice activity detecting method which are characterized in that assessed noise-power is determined for each active voice frame and the assessed noise-power is employed as quality.

According to the voice activity detecting device as structured above, the assessed noise-power is generally calculated by a simple arithmetic operation.

The above-described objects are also achieved by a voice activity detecting device which is characterized in that assessed noise-power and an assessed value for an SN ratio are determined for each active voice frame, and values given as a monotone nonincreasing function of the former and as a monotone nondecreasing function of the latter are employed as quality.

According to the voice activity detecting device as structured above, it is possible to determine, as non-active voice segment, even active voice frames having noise of a high level superimposed on and a small SN ratio with high accuracy.

The above-described objects are also achieved by a voice activity detecting device which is different from the voice activity detecting devices previously described in that a standardized random variable is employed in replace of assessed noise-power.

In the voice activity detecting device as structured above, a large absolute value of the standardized random variable signifies that a peak value of amplitude of an active voice frame is larger than standard amplitude of an aural signal, and that there is a high possibility that noise of a high level is superimposed on this active voice frame, and, that is, 'the larger the absolute value is, the higher the possibility becomes'. On the other hand, when the absolute value is smaller than the standard amplitude, it signifies that the peak value of the amplitude of the active voice frame is smaller than the standard amplitude of an aural signal, and the level of the noise superimposed on this active voice frame is low, and, that is, 'the smaller the absolute value, the smaller the peak value and the lower the level of noise'.

Therefore, the standardized random variable can substitute for the aforesaid assessed noise-power.

The above-described objects are also achieved by a voice activity detecting device which is characterized in that a standardized random variable is calculated approximately based on amplitude distribution of an active voice frame and the maximum value of the amplitude distribution.

According to the voice activity detecting device as structured above, the aforesaid standardized random variable can be calculated by a simple arithmetic operation.

The above-described objects are also achieved by a voice activity detecting device which is characterized in that previously obtained qualities on an active-voice-frame basis are integrated in order of time sequence to employ the resultant as quality.

According to the voice activity detecting device as structured above, it is able to reduce or suppress components of steep fluctuation which may accompany with the quality of aural signals obtained in order of time sequence.

The above-described objects are also achieved by a voice activity detecting device which is characterized in that previously obtained qualities on an active-voice-frame basis are integrated in order of time sequence to employ the resulting values as quality, the values being obtained by weighting the integration result with a smaller value as the integration result is larger.

According to the voice activity detecting device as structured above, subsequently given active voice frames are determined as active voice segment with higher accuracy as previously given active voice frames have higher quality and the high quality is gained at a larger hour rate.

BRIEF DESCRIPTION OF THE DRAWINGS

The nature, principle, and utility of the invention will become more apparent from the following detailed description when read in conjunction with the accompanying drawings in which like parts are designated by identical reference numbers, in which:

FIG. 12 is a block diagram showing a configuration example of a radio terminal equipment in which a voice activity detecting device is mounted.

DESCRIPTION OF THE PREFERRED EMBODIMENTS

The principles of a voice activity detecting device and a voice activity detecting method according to the present invention are first explained with reference to FIG. 1 and FIG. 2.

Figure 1:
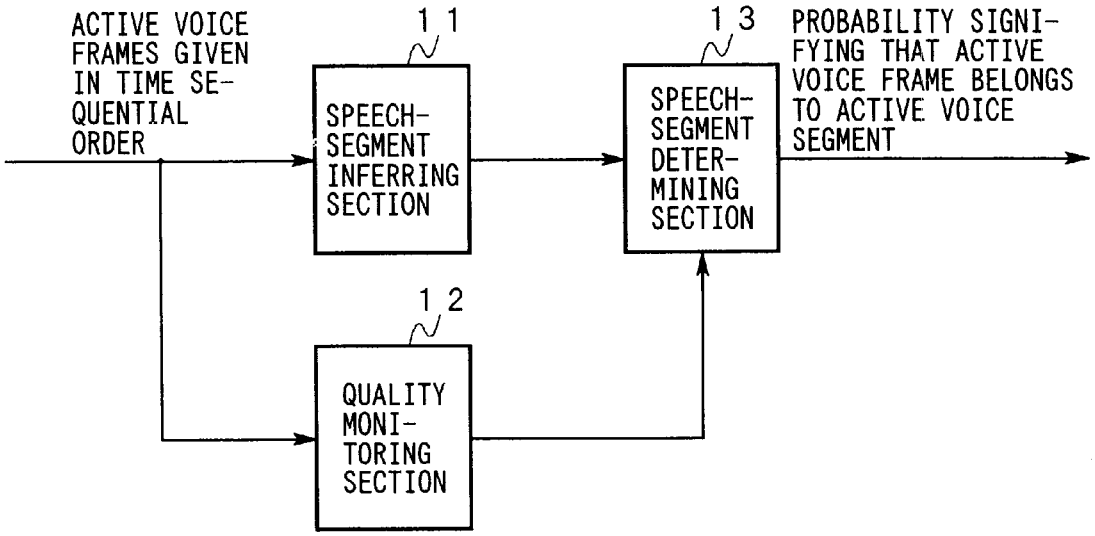
FIG. 1 is a block diagram of a first principle of the present invention.

FIG. 1 is a block diagram of a first principle of the present invention.

A voice activity detecting device shown in FIG. 1 is composed of a speech-segment inferring section 11, a quality monitoring section 12, and a speech-segment determining section 13.

The principle of a first voice activity detecting device according to the present invention is described as follows.

The speech-segment inferring section 11 determines, for each of active voice frames as an aural signal given in order of time sequence, a probability that the active voice frame belongs to an active voice segment, based on the statistical characteristic of the aural signal. The quality monitoring section 12 monitors quality of the aural signal for each of the active voice frames.

The speech-segment determining section 13 determines, for each of the active voice frames given in order of time sequence as an aural signals as described above, an accuracy that the active voice frame belongs to the active voice segment by weighting the probability determined by the speech-segment inferring section 11 with the monitored quality monitored by the quality monitoring section 12.

According to the voice activity detecting device as described above, each of the active voice frames is discriminated as an active voice segment with higher probability and discriminated as a non-active voice segment with lower probability as the aural signal has higher quality.

Therefore, even when an active voice segment includes many segments such as a consonant segment in which the quality of an aural signal is low because of its low amplitude, the segments are determined as a part of an active voice segment with high reliability.

Figure 2:
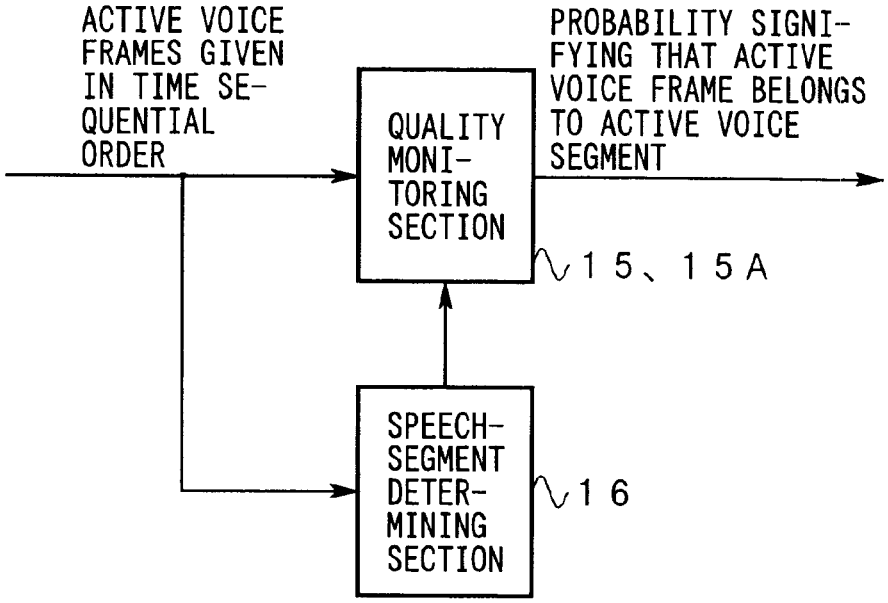
FIG. 2 is a block diagram of a second principle of the present invention.

FIG. 2 is a block diagram of a second principle of the present invention.

A voice activity detecting device shown in FIG. 2 is composed of a speech-segment inferring section 15 or 15A and a quality monitoring section 16.

The principle of a second voice activity detecting device according to the present invention is described as follows.

The speech-segment determining section 15 determines, for each of active voice frames as an aural signal given in order of time sequence, an accuracy that the active voice frame belongs to an active voice segment, based on the statistical characteristic of the aural signal. The quality monitoring section 16 monitors quality of the aural signal for each of these active voice frames.

The speech-segment determining section 15 also weights, for each of the active voice frames, a sequence of instantaneous values of the aural signal included in each of the active voice frames by a weighting given as a monotone decreasing function or a monotone nonincreasing function of the quality monitored by the quality monitoring section 16.

According to the voice activity detecting device as described above, the speech-segment determining section 15 weights the instantaneous values of the aural signal included in each of the active voice frames with a heavier weight as the quality is lower so as to determine the accuracy indicating that an aural signal given as a sequence of instantaneous values which are obtained as a result of the weighting belongs to the aforesaid active voice segment.

Therefore, even when an active voice segment includes many segments such as a consonant segment in which the quality of an aural signal is low because of its low amplitude, the segments are determined as a part of an active voice segment with high reliability.

The principle of a third voice activity detecting device according to the present invention is described as follows.

The quality monitoring section 16 monitors quality of an aural signal given as a sequence of active voice frames in order of time sequence, for each of the active voice frames.

The speech-segment determining section 15A performs companding processing for each of these active voice frames and analyzes a sequence of instantaneous values of the resulting aural signal from the companding processing based on the statistical characteristic of the aural signal so as to determine an accuracy that the active voice frame belongs to an active voice segment.

The speech-segment determining section 15A also applies a companding characteristic to the aforesaid companding processing for each of the active voice frames, the companding characteristic being given as a monotone decreasing function of the instantaneous values of the aural signal to the quality monitored by the quality monitoring section 16.

According to the voice activity detecting device as described above, the companding processing is performed the same as in the above second voice activity detecting device such that the lower quality an aural signal has, the more heavily weighted instantaneous values of the aural signal included in each of the active voice frames are.

Therefore, even when an active voice segment includes many segments such as a consonant segment in which the quality of an aural signal is low because of its low amplitude, the segments are determined as a part of an active voice segment with high reliability.

The principle of a fourth voice activity detecting device according to the present invention is described as follows.

The quality monitoring sections 12 and 16 determine the feature of an aural signal in an active voice segment and/or the feature of the aural signal in a non-active voice segment to obtain quality of this aural signal as one of the features or a difference between the features.

According to the voice activity detecting device as described above, the quality of the aural signal can be stably obtained as the aforesaid feature under application of various technologies realizing active voice analysis or speech analysis.

Therefore, accuracy indicating that each active voice frame belongs to the active voice segment is obtainable with reliability compared with the first to third voice activity detecting devices described above.

The principle of a fifth voice activity detecting device according to the present invention is described as follows.

The quality monitoring sections 12 and 16 determine assessed noise-power for each active voice frame to obtain quality of an aural signal as a monotone decreasing function of this assessed noise-power.

According to the voice activity detecting device as described above, the assessed noise-power is generally calculated by a simple arithmetic operation.

Therefore, it is possible to reduce throughput and enhance responsiveness compared with the first to third voice activity detecting devices described above.

The principle of a sixth voice activity detecting device according to the present invention is described as follows.

The quality monitoring sections 12 and 16 determine assessed noise-power and an assessed value of an SN ratio for each active voice frame to obtain quality of an aural signal as a monotone nonincreasing function of the former and a monotone nondecreasing function of the latter.

According to the voice activity detecting device as described above, it is able to determine, as non-active voice segment, even active voice frames having noise of a high level superimposed on and a small SN ratio with high accuracy.

The principle of a seventh voice activity detecting device according to the present invention is described as follows.

The quality monitoring sections 12 and 16 determine a standardized random variable for each active voice frame to obtain quality of an aural signal as a monotone nonincreasing function of the standardized random variable.

According to the voice activity detecting device as described above, a large absolute value of the standardized random variable signifies that a peak value of amplitude of an active voice frame is larger than standard amplitude of an aural signal, and that there is a high possibility that noise of a high level is superimposed on this active voice frame, and, that is, 'the larger the absolute value is, the higher the possibility becomes'. On the other hand, when the absolute value is smaller than the standard amplitude, it signifies that the peak value of the amplitude of the active voice frame is smaller than the standard amplitude of an aural signal, and the level of the noise superimposed on this active voice frame is low, and, that is, 'the smaller the absolute value, the smaller the peak value and the lower the level of noise'.

Therefore, It is possible, similarly to the above sixth voice activity detecting device, to determine even active voice frames having noise of a high level superimposed on and a low SN ratio as a part of an active voice segment with high accuracy,.

The principle of an eighth voice activity detecting device according to the present invention is described as follows.

The quality monitoring sections 12 and 16 determine a standardized random variable and an assessed value of an SN ratio for each active voice frame to obtain quality of an aural signal as a monotone nonincreasing function of the former and a monotone nondecreasing function of the latter.

According to the voice activity detecting device as described above, It is possible to determine even active voice frames having noise of a high level superimposed on and a low SN ratio as a part of an active voice segment with high accuracy.

The principle of a ninth voice activity detecting device according to the present invention is described as follows.

The quality monitoring sections 12 and 16 determine a peak value of instantaneous values of the aural signal included in each of the active voice frames; calculate amplitude normalized by a standard deviation of this probability density function by applying, to a probability density function approximating to amplitude distribution of the aural signal, the number of the instantaneous values and a probability at which the peak value appears; and determine a standardized random variable as a ratio of the amplitude to the peak value.

According to the voice activity detecting device as described above, the aforesaid standardized random variable can be determined based on a simple arithmetic operation compared with the fifth voice activity detecting device previously described.

Therefore, it is able to reduce throughput to be ensured for acquiring desired responsiveness or to improve the responsiveness, compared with the fifth voice activity detecting device previously described.

The principle of a tenth voice activity detecting device according to the present invention is described as follows.

The quality monitoring sections 12 and 16 integrate the obtained quality of the aural signal in sequence to apply the result of the integration as normal quality.

According to the voice activity detecting device as described above, it is possible to reduce or suppress a component of steep fluctuation which may possibly accompany with the quality of the aural signal obtained in order of time sequence.

Therefore, the voice activity detecting device of the present invention can adapt to various noises which may possibly occur with the aural signal, and its performance can be stabilized.

The principle of an eleventh voice activity detecting device according to the present invention is described as follows.

The quality monitoring sections 12 and 16 integrate the obtained quality of the aural signal in sequence and apply as its quality a value which is obtained as a monotone increasing function or a monotone nondecreasing function of the result of the integration.

According to the voice activity detecting device as described above, a subsequently given active voice frame is determined as an active voice segment with higher accuracy as a previously given active voice frame has higher quality and the high quality is gained at a larger hour rate.

The principle of a first voice activity detecting method according to the present invention is described as follows.

According to the first voice activity detecting method, a probability that each active voice frame belongs to an active voice segment is determined for each of active voice frames given as an aural signal in order of time sequence, based on the statistical characteristic of the aural signal, and quality of the aural signal is monitored.

Furthermore, an accuracy that the active voice frame belongs to the active voice segment is obtained for each of the active voice frames by weighting the probability determined with the monitored quality.

According to the voice activity detecting method as described above, the higher quality each of the active voice frames has, with higher probability discriminated it is as the active voice segment and also with lower probability discriminated as a non-active voice segment.

Therefore, even when an active voice segment includes many segments such as a consonant segment in which the quality of an aural signal is low because of its low amplitude, the segments are determined as a part of an active voice segment with high reliability.

The principle of a second voice activity detecting method according to the present invention is described as follows.

According to the second voice activity detecting method, for each of active voice frames given as aural signals in order of time sequence, a probability that the active voice frame belongs to an active voice segment is determined based on the statistical characteristic of the aural signal, and quality is monitored for each frame.

Furthermore, a sequence of instantaneous values of the aural signal included in each of the active voice frames is weighted with a weighting given as a monotone decreasing function or a monotone nonincreasing function of the monitored quality above.

According to the voice activity detecting method as described above, a heavier weighting is given to instantaneous values of an aural signal included in each of the active voice frames as the active voice frame has lower quality to obtain the aforesaid accuracy that the resulting aural signal given as a sequence of instantaneous values belongs to the active voice segment.

Therefore, even when an active voice segment includes many segments such as a consonant segment in which the quality of an aural signal is low because of its low amplitude, the segments are determined as a part of an active voice segment with high reliability.

The principle of a third voice activity detecting method according to the present invention is described as follows.

According to the third voice activity detecting method, an accuracy that the active voice frame belongs to an active voice segment is obtained by performing companding processing for each of active voice frames given in order of time sequence and by analyzing a sequence of instantaneous values of an aural signal obtained in the companding processing based on the statistical characteristic of this aural signal, and quality of the aural signal is monitored.

Moreover, a companding characteristic which is given as a monotone decreasing function of thus monitored quality is applied to the companding processing for each of the active voice frames.

According to the above voice activity detecting device similar to the second voice activity detecting method, the companding processing is performed such that the lower quality an aural signal has, the more heavily weighted instantaneous values of the aural signal included in each of the active voice frames are.

Therefore, even when an active voice segment includes many segments such as a consonant segment in which the quality of an aural signal is low because of its low amplitude, the segments are determined as a part of an active voice segment with high reliability.

Embodiments of the present invention are hereinafter explained in detail with reference to the drawings.

Figure 3:
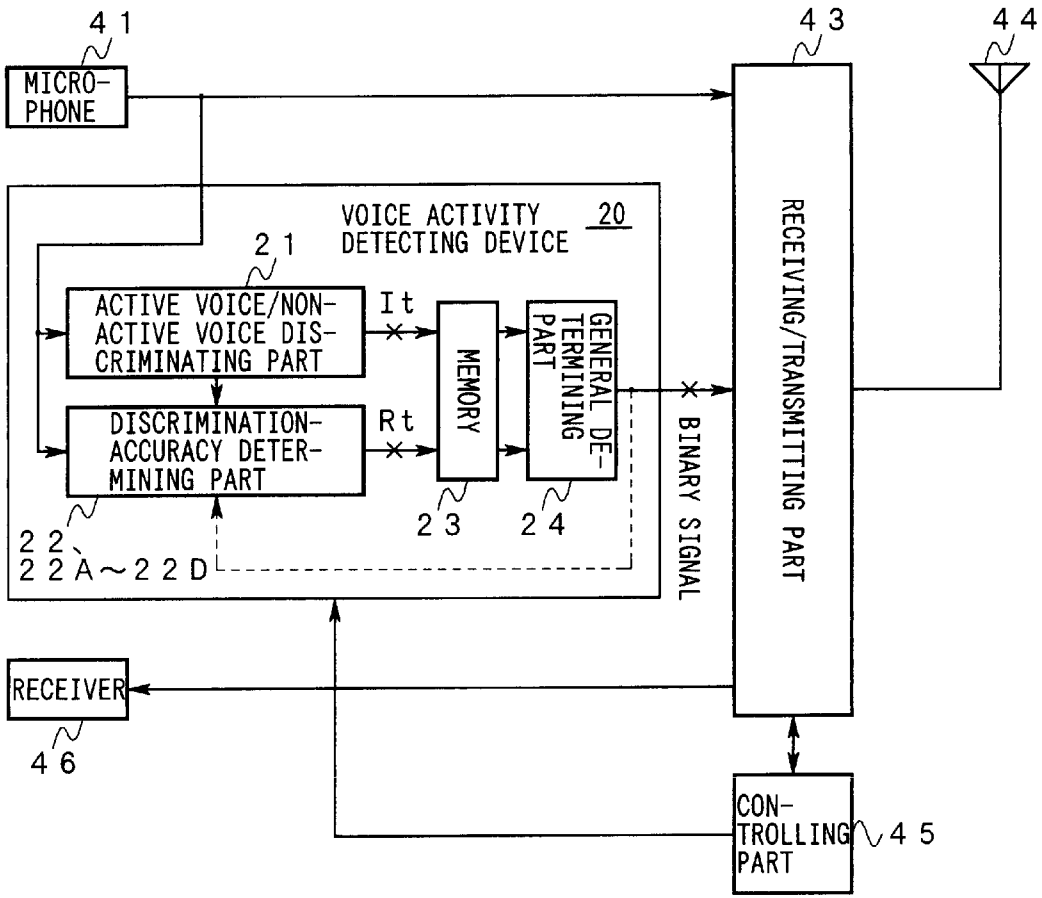
FIG. 3 is a block diagram showing embodiments 1 and 3 to 8 of the present invention.

FIG. 3 is a block diagram showing embodiments 1 and 3 to 8 of the present invention.

In FIG. 3, the same reference numerals and symbols are used to designate components having the same functions and structures as those shown in FIG. 12, and therefore, the explanations thereof are omitted here.

The configuration of this embodiment is different from that of the conventional example shown in FIG. 12 in that a voice activity detecting device 20 is provided instead of the voice activity detecting device 42.

The voice activity detecting device 20 is composed of an active voice/non-active voice discriminating part 21 provided on a first stage, a discrimination-accuracy determining part 22 which has a monitor terminal directly connected to a monitor output of the active voice/non-active voice discriminating part 21 and which is provided on the first stage together with this active voice/non-active voice discriminating part 21, a memory 23 having two ports connected to outputs of the active voice/non-active voice discriminating part 21 and the discrimination-accuracy determining part 22 respectively, and a general determining part 24 which is directly connected to an output of the memory 23 and is provided as a final stage.

Figure 4:
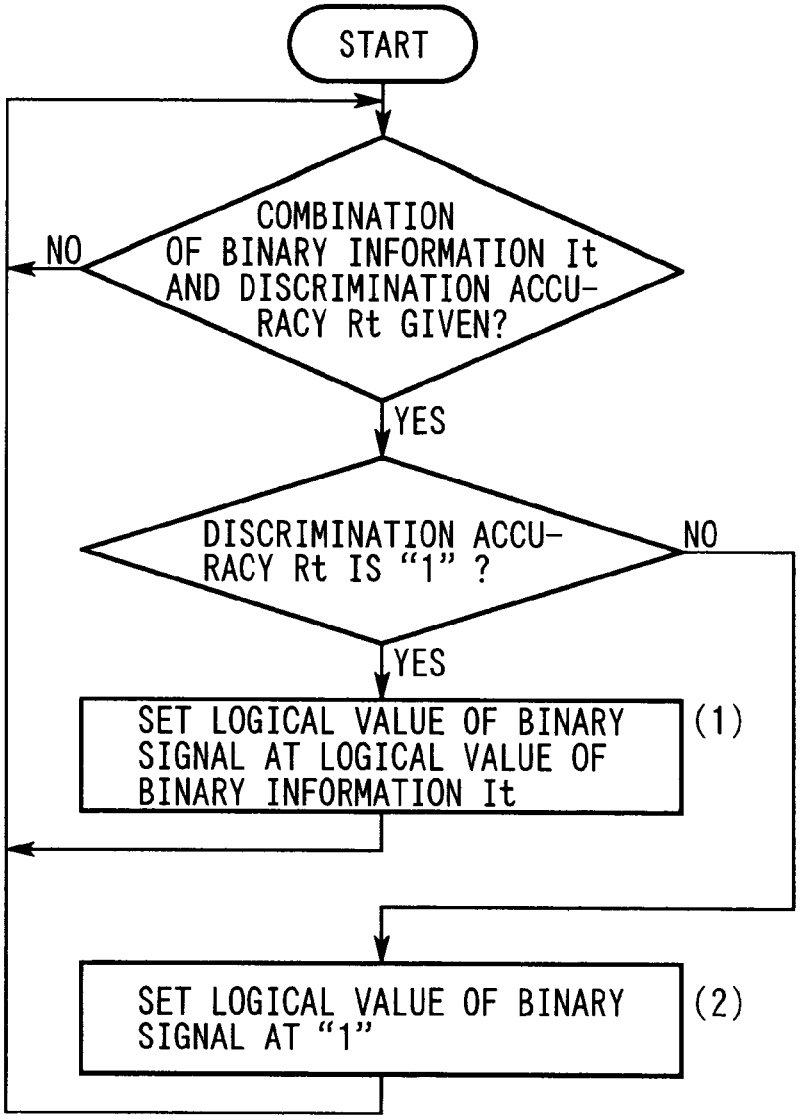
FIG. 4 is an operation flow chart of the embodiment 1.

FIG. 4 is an operation flow chart of the embodiment 1.

Embodiment 1

The operation of the embodiment 1 according to the present invention is hereinafter explained with reference to FIG. 3 and FIG. 4.

In the voice activity detecting device 20, the active voice/non-active voice discriminating part 21 performs the same processing as that performed by the voice activity detecting device 42 shown in FIG. 12 for aural signals given thereto via the microphone 41 to discriminate whether each of the active voice frames mentioned above belongs to an active voice segment or a non-active voice segment and gives binary information "It" indicating the result of this discrimination to the memory 23 and the discrimination-accuracy determining part 22 in parallel.

Incidentally, a logical value of this binary information "It" is supposed to be set at '1' in the active voice segment and on the other hand, '0' in the non-active voice segment for simplification.

Meanwhile, the discrimination-accuracy determining part 22 converts the aforesaid aural signals into a sequence of the aforesaid active voice frames in parallel with the active voice/non-active voice discriminating part 21. Furthermore, the discrimination-accuracy determining part 22 discriminates between the active voice segment and the non-active voice segment according to the logical value of the binary information "If" which is given by the active voice/non-active voice discriminating part 21 and steadily monitors distribution (a mean value) of a feature value Ft (supposed to be energy and/or a zero crossing frequency for simplification here) of each of the active voice frames in these segments.

The discrimination-accuracy determining part 22 also judges whether or not a difference of the distribution (the mean value) of the aforesaid feature value Ft in the active voice segment from that in the non-active voice segment is lower than a predetermined threshold value Fth during a period when each of the active voice frames is given and determines binary discrimination accuracy Rt indicating the result of the judgment.

Note that the logical value of this discrimination accuracy Rt is supposed to be set at '0' when the quality of the aural signal is low to the extent to cause the aforesaid difference to be lower than the threshold value Fth, while it is supposed to be set at '1' when the quality of the aural signal is high to the extent to cause the difference to exceed the threshold value Fth.

Meanwhile, the binary information "It" given by the active voice/non-active voice discriminating part 21 and the discrimination accuracy Rt determined by the discrimination-accuracy determining part 22 are stored in the memory 23, correspondingly to each of the aforesaid active voice frames.

The general determining part 24 performs the following processing in sequence according to each combination of the binary information "It" and the discrimination accuracy Rt stored in this way in the memory 23:

to give to the receiving/transmitting part 43 a binary signal whose logical value is equal to the logical value of the binary information "It" when the logical value of the discrimination accuracy Rt is '1' (FIG. 4(1)); and to give a binary signal whose logical value is '1' to the receiving/transmitting part 43 when the logical value of the discrimination accuracy Rt is '0' (FIG. 4(2)).

Meanwhile, the receiving/transmitting part 43 delays the process of transmitting a transmission wave signal which is modulated by the aural signal given by the microphone 41 to a radio channel which is allotted under channel control performed by the controlling part 45, for a length of time equal to execution time of processing performed for each of the active voice frames in the voice activity detecting device 20 as described above, so that synchronization with this voice activity detecting device 20 is maintained.

In short, the binary information "It" given by the active voice/non-active voice discriminating part 21 is given to the receiving/transmitting part 43 as the binary signal when the quality of the aural signal is high, while the logical value of this binary signal is set at '1' indicating the active voice segment when the quality is not high.

Therefore, according to this embodiment, the active voice segment in which the quality of the aural signal is low is prevented from being discriminated as the non-active voice segment with high reliability and deterioration in transmission quality is suppressed, compared with the conventional example in which the active voice segment and the nonactive voice segment are discriminated based only on the statistical characteristic of the aural signal regardless of the logical value of the discrimination accuracy Rt.

Incidentally, in this embodiment, the active voice/non-active voice discriminating part 21 and the discrimination-accuracy determining part 22 individually perform in parallel processing for converting the aural signals to the sequence of the active voice frames.

However, either one of the active voice/non-active voice discriminating part 21 and the discrimination-accuracy determining part 22 may play a leading role in this processing, or some means disposed on a preceding stage of the active voice/non-active voice discriminating part 21 and the discrimination-accuracy determining part 22 may perform this processing.

Moreover, in this embodiment, the binary information "It" determined by the active voice/non-active voice discriminating part 21 and the discrimination accuracy Rt determined by the discrimination-accuracy determining part 22 are stored in the memory 23 correspondingly to each of the active voice frames.

However, the memory 23 need not be provided when fluctuation which may possibly accompany with the execution time of the aforesaid processing to be performed by the active voice/non-active voice discriminating part 21, the discrimination-accuracy determining part 22, and the general determining part 24 is tolerably small.

Furthermore, in this embodiment, the receiving/transmitting part 43 delays the process for a length of time equal to the execution time of the processing performed for each of the active voice frames by the voice activity detecting device 20 to maintain the synchronization with this voice activity detecting device 20.

However, such delay need not be given at all when the delay is so short that the aforesaid synchronization can be maintained with desired accuracy.

Moreover, in this embodiment, the discrimination-accuracy determining part 22 determines the aforesaid discrimination accuracy Rt.

However, function distribution may be realized in any form between the discrimination-accuracy determining part 22 and the general determining part 24, for example, by having the discrimination-accuracy determining part 22 only perform either one of the following processing:

to determine the distribution (the mean value) of the aforesaid feature values Ft in the active voice segment and the non-active voice segment at an instant or during a period when the aforesaid active voice frame is given; and to determine the distribution (the mean value) of the feature values Ft and judge whether or not a gap (a difference) between them exceeds the predetermined threshold value Fth.

Furthermore, in this embodiment, the quality of the aural signal is judged to be high or not based on the judgment whether or not the difference of the feature value Ft in the active voice segment from that in the non-active voice segment is lower than the threshold value Fth.

However, the present invention is not limited to this structure, and for example, when the feature value of either one of the active voice segment and the non-active voice segment is given as a known value with desired accuracy, only the feature value of the other may be determined to judge transmission quality of the aural signal based on judgment whether or not this feature value is lower than a prescribed threshold value.

Embodiment 2

Figure 5:
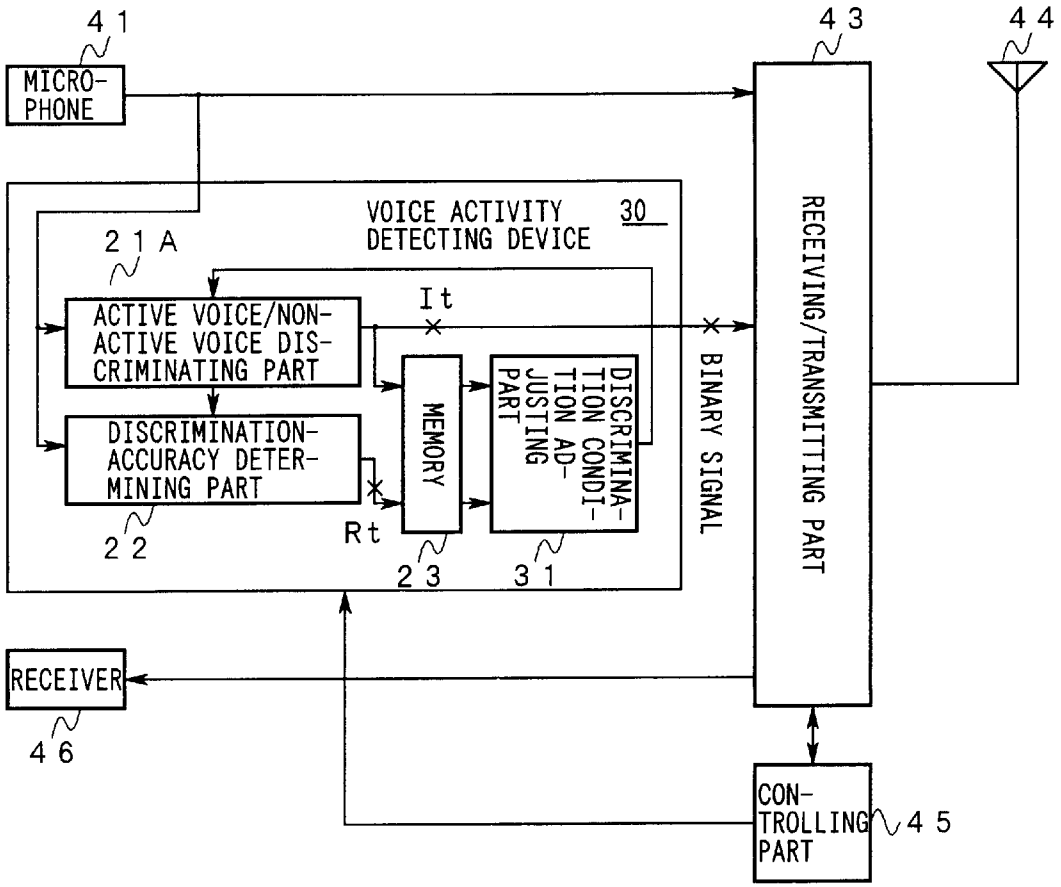
FIG. 5 is a block diagram showing an embodiment 2 of the present invention.

FIG. 5 is a block diagram showing an embodiment 2 of the present invention.

In FIG. 5, the same reference numerals and symbols are used to designate components having the same functions and structures as those shown in FIG. 3 and therefore, the explanations thereof are omitted here.

The configuration of this embodiment is different from that of the embodiment 1 described above in that a voice activity detecting device 30 is provided instead of the voice activity detecting device 20.

The configuration of the voice activity detecting device 30 is different from that of the voice activity detecting device 20 in that an active voice/non-active voice discriminating part 21A is provided instead of the active voice/non-active voice discriminating part 21, a discrimination condition adjusting part 31 is provided instead of the general determining part 24, an output of this discrimination condition adjusting part 31 is connected to a threshold value input of the active voice/non-active voice discriminating part 21A instead of being connected to the corresponding control input of the receiving/transmitting part 43, and to this control input, an output of the active voice/non-active voice discriminating part 21A is connected.

Figure 6:
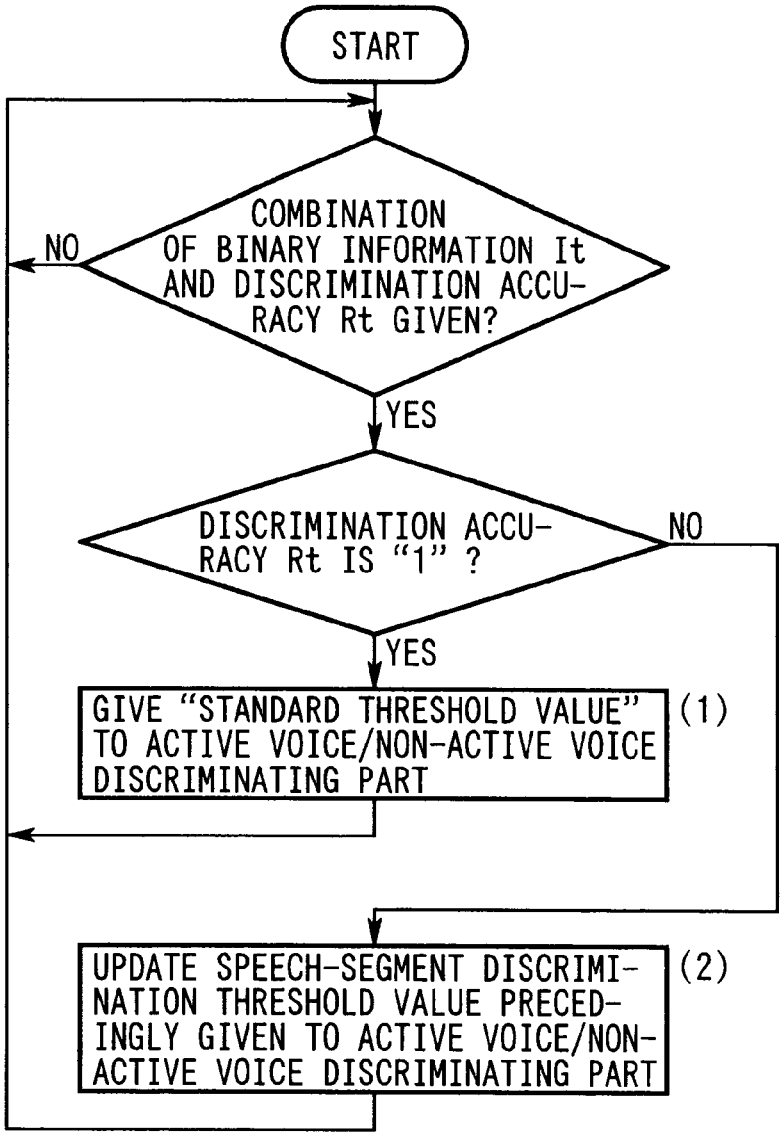
FIG. 6 is an operation flow chart of the embodiment 2.

FIG. 6 is an operation flow chart of the embodiment 2.

The operation of the embodiment 2 according to the present invention is hereinafter explained with reference to FIG. 5 and FIG. 6.

This embodiment is different from the embodiment 1 in the following processing performed by the discrimination condition adjusting part 31 and in that the active voice/non-active voice discriminating part 21A determines the aforesaid binary information "It" based on a threshold value given under the processing.

Incidentally, since in the explanation below, the procedure for the processing performed by the active voice/non-active voice discriminating part 21A, the discrimination-accuracy determining part 22, and the memory 23 operating in association with one another is basically the same as that in the embodiment 1 described above, the explanation thereof is omitted here.

The active voice/non-active voice discriminating part 21A performs the same processing for an aural signal given via the microphone 41 as that performed by the voice activity detecting device 42 mounted in the conventional example shown in FIG. 12, and applies a value given by the discrimination condition adjusting part 31 as a threshold value (hereinafter referred to as a 'speech-segment discrimination threshold value') relating to the statistical characteristic of this aural signal in the process of this processing to determine the binary information "It".

Meanwhile, the discrimination condition adjusting part 31 accepts the combination of thus determined binary information "It" and the discrimination accuracy Rt determined by the discrimination accuracy determining part 22 in sequence via the memory 23 and performs the following processing It gives to the active voice/non-active voice discriminating part 21A "a standard speech-segment discrimination threshold value (hereinafter, referred to as a 'standard threshold value') which the active voice/non-active voice discriminating part 21A is to apply in the process of determining the binary information "It" during a period when the quality of the aforesaid aural signal is high", when the logical value of the discrimination accuracy Rt is '1' (FIG. 6(1)). Incidentally, the standard threshold value is supposed to be given to the discrimination condition adjusting part 31 in advance.

It updates or sets the speech-segment discrimination threshold value (the aforesaid 'standard threshold value' is also acceptable) precedingly given to the active voice/non-active voice discriminating part 21A at either one of the following values when the logical value of the discrimination accuracy Rt is '0' (FIG. 6(2)):

a value to cause the active voice/non-active voice discriminating part 21A to discriminate a subsequent active voice frame as an active voice frame belonging to the active voice segment with high probability; and a value to cause the active voice/non-active voice discriminating part 21A to surely discriminate a subsequent active voice frame as an active voice frame belonging to the active voice segment.

Furthermore, the receiving/transmitting part 43 accepts a sequence of the binary information "It" given by the active voice/non-active voice discriminating part 21A as the aforesaid binary signal and maintains synchronization with the voice activity detecting device 30 similarly to the embodiment 1 described above.

In this way, according to this embodiment, the binary information "It" given by the active voice/non-active voice discriminating part 21A is given to the receiving/transmitting part 43 as the binary signal when the quality of the aural signal is high, while the speech-segment discrimination threshold value is appropriately updated to increase "the probability that the logical value of this binary signal is set at '1' indicating the active voice segment" when this quality is not high.

Consequently, according to this embodiment, deterioration in transmission quality which is caused because the active voice segment in which this quality is low is discriminated as the non-active voice segment is suppressed or avoided, compared with the conventional example where the active voice segment and the non-active voice segment are discriminated based only on the statistical characteristic of the aural signal regardless of the logical value of the discrimination accuracy Rt.

Incidentally, the speech-segment discrimination threshold value is appropriately updated or set by the discrimination condition adjusting part 31 in this embodiment.

However, the present invention is not limited to this structure, and for example, when a variable gain amplifier for amplifying the aural signal in a linear region is mounted in the active voice/non-active voice discriminating part 21A and the active voice segment and the non-active voice segment are discriminated based on the level of the aural signal, a gain of this variable gain amplifier may be varied instead of the aforesaid speech-segment discrimination threshold value.

Embodiment 3

The configuration of this embodiment is different from that of the embodiment 1 in that a discrimination-accuracy. determining part 22A is provided instead of the discrimination-accuracy determining part 22.

Figure 7:
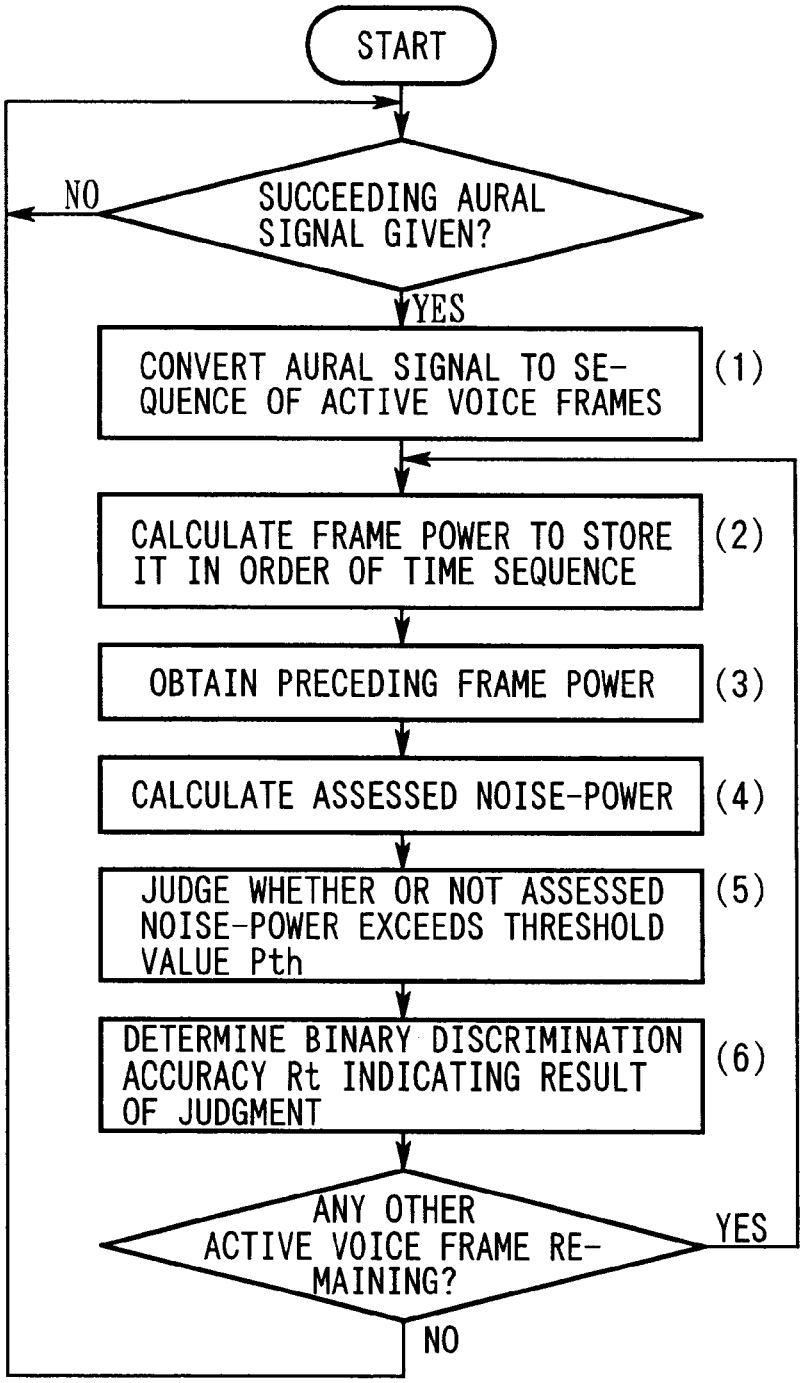
FIG. 7 is an operation flow chart of the embodiment 3.

FIG. 7 is an operation flow chart of the embodiment 3.

The operation of this embodiment is hereinafter explained with reference to FIG. 3 and FIG. 7.

This embodiment is characterized by the procedure for the following processing performed by the discrimination-accuracy determining part 22A.

The discrimination-accuracy determining part 22A converts aural signals to a sequence of active voice frames in parallel with the active voice/non-active voice discriminating part 21(FIG. 7(1)) and performs the following processing for each of the active voice frames.

Note that for simplification, the individual active voice frames are supposed to be given in the order of time sequence t (=0 to N) as a sequence of instantaneous values x(t) which are (N+1) in number.

1. to execute an arithmetic operation expressed by the following formula (1) to calculate frame power $P_t$ and to store it in the order of the time sequence t (FIG. 7(2))

$$P_t = \sum_{t=0}^{N} x(t)^2 \quad (1)$$

2. to obtain preceding frame power $P_{t-1}$ which is calculated and stored similarly for a preceding active voice frame (FIG. 7(3))
3. to execute an arithmetic operation expressed by the following formula (2) for a prescribed time constant $\alpha$ (<1) to calculated assessed noise-power $P_{Nt}$ based on exponential smoothing (FIG. 7(4))

$$P_{Nt=\alpha Pt-1}+(1-\alpha)P_t \quad (2)$$

4. to compare this assessed noise-power $P_{Nt}$ with a threshold value Pth which is set in advance for the assessed noise-power $P_{Nt}$ similarly to the aforesaid threshold value Fth and thereby, to judge whether or not the former exceeds the latter (FIG. 7(5)) to determine the binary discrimination accuracy Rt indicating the result of the judgment (FIG. 7(6))

Note that the logical value of this discrimination accuracy Rt is supposed to be set at '0' (signifying that the quality of a speech signal is low) when the result of the aforesaid judgment is true, while it is set at '1' (signifying that the quality of the speech signal is high) when the result of the judgment is false.

Moreover, the general determining part 24 generates a binary signal by referring to this discrimination accuracy Rt similarly to the embodiment 1 described above and gives the binary signal to the receiving/transmitting part 43 in sequence.

As described above, according to this embodiment, the quality of the speech signal can be easily determined by the simple arithmetic operations expressed by the above formulas (1) and (2), and a period during which the result of the aforesaid judgment is false is reliably discriminated as an active voice period regardless of the logical value It of the binary information given by the active voice/non-active voice discriminating part 21.

Embodiment 4

The configuration of this embodiment is different from that of the embodiment 1 in that a discrimination-accuracy determining part 22B is provided instead of the discrimination-accuracy determining part 22.

Figure 8:
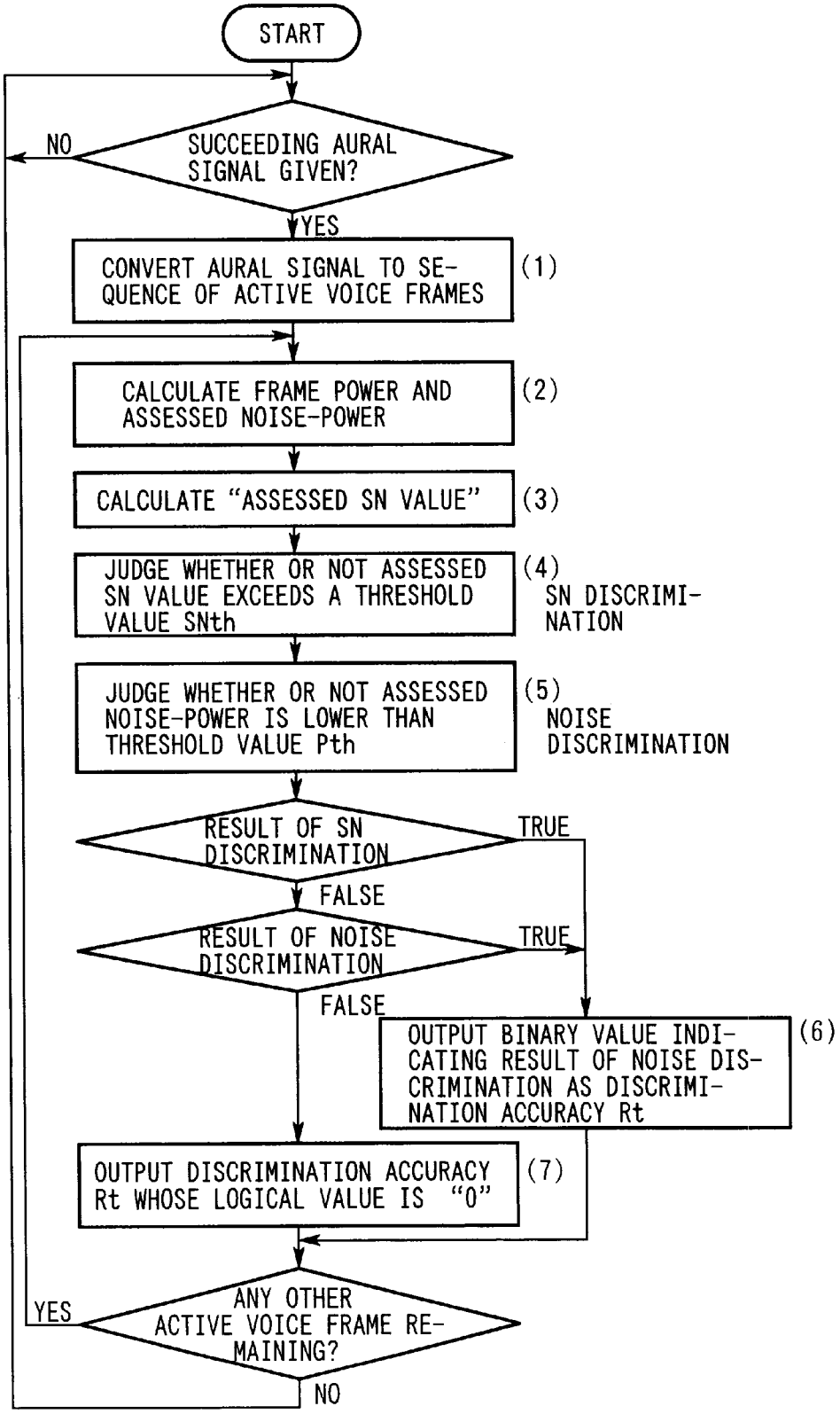
FIG. 8 is an operation flow chart of the embodiment 4.

FIG. 8 is an operation flow chart of the embodiment 4.

The operation of this embodiment is hereinafter explained with reference to FIG. 3 and FIG. 8.

This embodiment is characterized by the procedure for the following processing performed by the discrimination-accuracy determining part 22B.

The discrimination-accuracy determining part 22B converts aural signals to a sequence of active voice frames in parallel with the active voice/non-active voice discriminating part 21 (FIG. 8(1)) and performs the following processing for each of the active voice frames.

1. to calculate the frame power $P_t$ and the assessed noise-power $P_{Nt}$ based on the same procedure as the procedure for the processing performed by the discrimination-accuracy determining part 22A in the embodiment 3 described above (FIG. 8(2))
2. to execute an arithmetic operation expressed by the following formula (3) to calculate an assessed value $SN_t$ of an SN ratio (hereinafter referred to simply as an 'assessed SN value') of this active voice frame (FIG. 8(3))
3. to judge whether or not this assessed SN value $SN_t$ exceeds a threshold value SNth which is set for this assessed SN value $SN_t$ in advance similarly to the aforesaid threshold value Fth (hereinafter referred to as 'SN discrimination') (FIG. 8(4))
4. to judge whether or not the aforesaid assessed noise-power $P_{Nt}$ is lower than the aforesaid threshold value Pth (hereinafter referred to as 'noise discrimination') (FIG. 8(5))
5. to determine the discrimination accuracy Rt in the following way according to the combination of the results of these judgments and output it ① In a case the result of the SN discrimination is true and in a case the result of this SN discrimination is false as well as the result of the noise discrimination is true, a binary value indicating the result of this noise discrimination is outputted as the discrimination accuracy Rt (FIG. 8(6)).

② In a case the result of the SN discrimination is false as well as the result of the noise discrimination is false, the discrimination accuracy Rt whose logical value is '0' is outputted (FIG. 8(7)).

$$SN_t=10log_{10}(P_t/P_{Nt}) \quad (3)$$

Therefore, in a case the assessed SN value $SN_t$ is small and the aforesaid assessed noise power $P_{Nt}$ is large, the general determining part 74 is prevented from discriminating the active voice segment as the non-active voice segment with high reliability even when the accuracy of the discrimination made by the active voice/non-active voice discriminating part 21 is lowered to a great extent.

Embodiment 5

The configuration of this embodiment is different from that of the embodiment 1 in that a discrimination-accuracy determining part 22C is provided instead of the discrimination-accuracy determining part 22.

Figure 9:
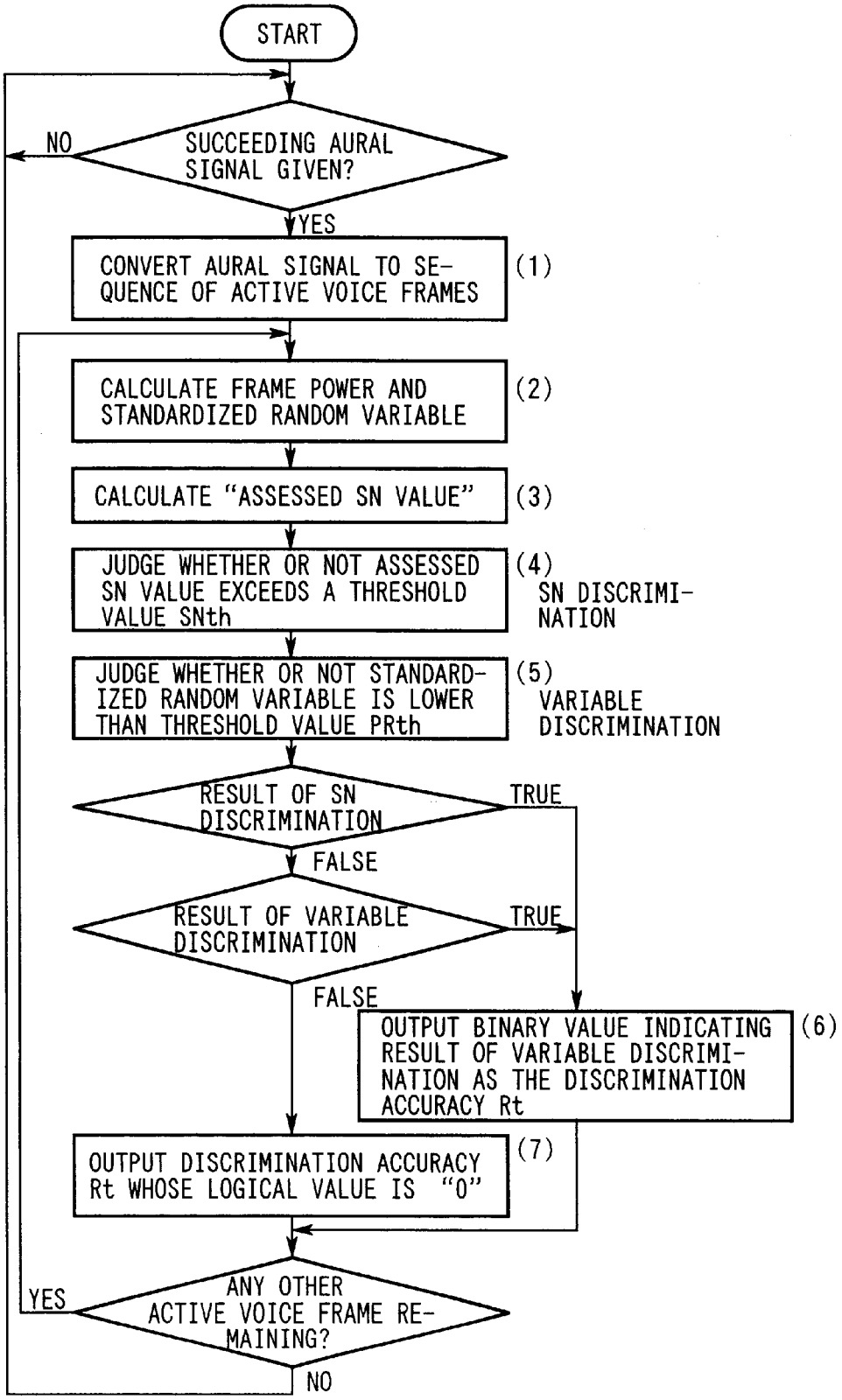
FIG. 9 is an operation flow chart of the embodiment 5.

FIG. 9 is an operation flow chart of the embodiment 5.

The operation of this embodiment is hereinafter explained with reference to FIG. 3 and FIG. 9.

This embodiment is different from the embodiment 4 described above in the procedure for the following processing performed by the discrimination-accuracy determining part 22C.

The discrimination-accuracy determining part 22C converts aural signals to a sequence of active voice frames in parallel with the active voice/non-active voice discriminating part 21 (FIG. 9(1)) and performs the following processing for each of the active voice frames instead of the processing for calculating the assessed noise-power $P_{Nt}$.

A) to determine and store a peak value $S_{Pt}$ and a mean value $S_{mt}$ of amplitude of the aural signal which is shown in the individual active voice frames given in the order of the time sequence t B) every time the latest active voice frame is given, to obtain the peak value $S_{pt}$ and the mean value $S_{mt}$, which have been similarly stored, for active voice frames which are M in number and which are given respectively for a predetermined number M in the order of the time sequence t in a period preceding the instant this latest active voice frame is given C) to calculate a standard deviation $\sigma_t$ of the amplitude of the aural signal given as a corresponding active voice frame as a result of an arithmetic operation which is executed by substituting the peak value and the mean value in the following formula (4)

$$\sigma_t = \left[\left\{\sum_{t=(t-M)}^{t} (S_{Pt} - S_{mt})^2 / M\right\}\right]^{1/2} \tag{4}$$

D) to determine a peak value x of the amplitude of an aural signal which is shown in the latest active voice frame E) to execute an arithmetic operation expressed by the following formula (5) for the standard deviation $\sigma_t$ and the peak value x to calculate a standardized random variable $Pr_t$ of the amplitude of the above-mentioned aural signal (FIG. 9(2))

$$Pr_t = x/\sigma_t \tag{5}$$

Note that the standardized random variable $Pr_t$ signifies correlation between the peak value $S_{pt}$ of the amplitude of the aural signal included in the latest active voice frame and distribution of the amplitude.

Moreover, the standardized random variable $Pr_t$ signifies, as its absolute value is larger, that 'the peak value of the amplitude of the latest active voice frame is larger compared with standard amplitude of the aural signal and noise of a high level is superimposed on this active voice frame with higher possibility' and on the other hand, it signifies, as its absolute value is smaller, that 'the peak value of the amplitude of the latest active voice frame is smaller compared with the standard amplitude of the aural signal and a level of the noise superimposed on this active voice frame is lower.'

The discrimination-accuracy determining part 22C also determines the assessed SN value $SN_t$ (FIG. 9(3)) similarly to the embodiment 4 to execute the 'SN judgment' (FIG. 9(4)).

The discrimination-accuracy determining part 22C further judges whether or not the aforesaid standardized random variable $Pr_t$ is lower than a prescribed threshold value Prth (hereinafter referred to as 'variable discrimination') (FIG. 9(5)).

Moreover, the discrimination-accuracy determining part 22C determines the discrimination accuracy Rt in the following way according to the combination of the results of these discriminations and outputs it.

I. In a case the result of the SN discrimination is true and in a case the result of the variable discrimination is true, a binary value indicating the result of this variable discrimination is outputted as the discrimination accuracy Rt (FIG. 9(6)).

II. In a case the result of the SN discrimination is false as well as the result of the variable discrimination is false, the discrimination accuracy Rt whose logical value is '0' is outputted (FIG. 9(7)).

Therefore, in a case the value of the standardized random variable $Pr_t$ is large, this logical value of the discrimination accuracy Rt prevents the general determining part 74 from discriminating the active voice segment as the non-active voice segment with high reliability even when the accuracy of the discrimination made by the active voice/non-active voice discriminating part 21 is lowered to a great extent.

Embodiment 6

The configuration of this embodiment is different from that of the embodiment 5 in hat a discrimination-accuracy determining part 22D is provided instead of the iscriminating-accuracy determining part 22.

Figure 10:
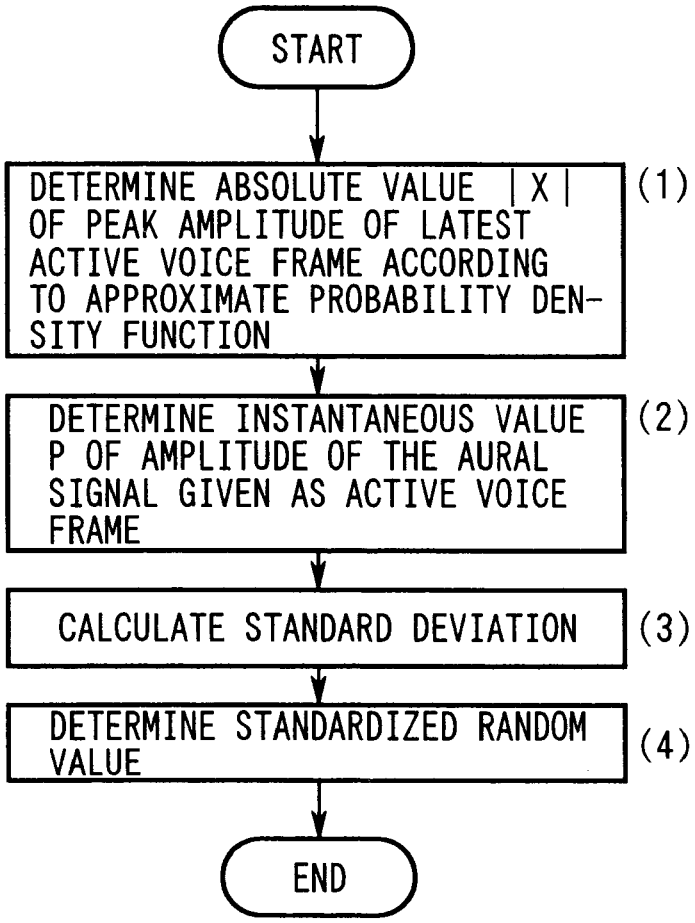
FIG. 10 is an operation flow chart of the embodiment 6.

FIG. 10 is an operation flow chart of the embodiment 6.

The operation of this embodiment is hereinafter explained with reference to FIG. 3 and FIG. 10.

This embodiment is different from the embodiment 5 in that the standardized random variable $Pr_t$ is calculated by a discrimination-accuracy determining part 22D instead of the discrimination-accuracy determining part 22C based on a later-described procedure.

A probability density function indicating amplitude distribution of an aural signal can generally be approximated to by Gamma distribution and Laplace distribution.

Furthermore, this probability density function P(x) is defined by the following formula for amplitude x of the aural signal normalized by a standard deviation when it is approximated to, for example, by the aforesaid Laplace distribution.

$$P(x) = (1/\sqrt{2}) exp\,(-\sqrt{2}\cdot|x|)$$

Therefore, an absolute value of the amplitude x of the aural signal normalized by the standard deviation is given by the following formula.

$$|x| = (-1/\sqrt{2})\cdot \mathrm{In}(\sqrt{2}\cdot P\,(x)) \tag{6}$$

Incidentally, the number K of sample values (supposed to be '1000' for simplification here) which are included in an individual active voice frame and which are sampled and undergo predetermined digital signal processing is generally given as a known value.

Moreover, in this case, the probability that the peak value of the amplitude appears in an aural signal included in the individual active voice frame is given as (1/K).

The discrimination accuracy determining part 22D executes an arithmetic operation expressed by the following formula which is obtained by applying this probability (=1/K) to the above formula (6) to determine a value of |x| as the result of the arithmetic operation (FIG. 10(1)).

$$\begin{aligned} |x| &= \left(-1/\sqrt{2}\right)\cdot \ln\left(\sqrt{2}\cdot(1/K)\right) \\ &= \left(-1/\sqrt{2}\right)\cdot \ln\left(\sqrt{2}\cdot(1/1000)\right) \end{aligned}$$

The discrimination-accuracy determining part 22D also determines an instantaneous value p of the amplitude of the aural signal given as a corresponding active voice frame (FIG. 10(2)) and executes an arithmetic operation expressed by the following formula for the instantaneous value p and the aforesaid value of |x| to calculate the standard deviation $\sigma_t$ (FIG. 10(3)) and determines the standardized random value $Pr_t$ by substituting the value of this standard deviation $\sigma_t$ in the aforesaid formula (5) (FIG. 10(4)).

$$\sigma_t = p/|x|$$

Therefore, the standardized random variable $Pr_t$ can be determined based on a simple arithmetic operation compared with the aforesaid processing A) to E) performed in the embodiment 5.

Consequently, according to this embodiment, throughput to be secured to obtain desired responsiveness can be reduced or the responsiveness can be improved compared with the embodiment 5.

Incidentally, the discrimination-accuracy determining part 22D performs the aforesaid processing for each unit active voice frame in this embodiment.

However, similar processing may be performed for a desired plural number of active voice frames which are given in order of time sequence as a unit to compress errors in the processing described above. Incidentally, the embodiments 3 to 6 are configured with the changes described above being made to the configuration of the embodiment 1.

However, these embodiments may be configured by applying similar inventions to the configuration of the embodiment 2.

Embodiment 7

The configuration of this embodiment may be the same as that of any one of the mbodiment 1 to the embodiment 6 described above.

Figure 11:
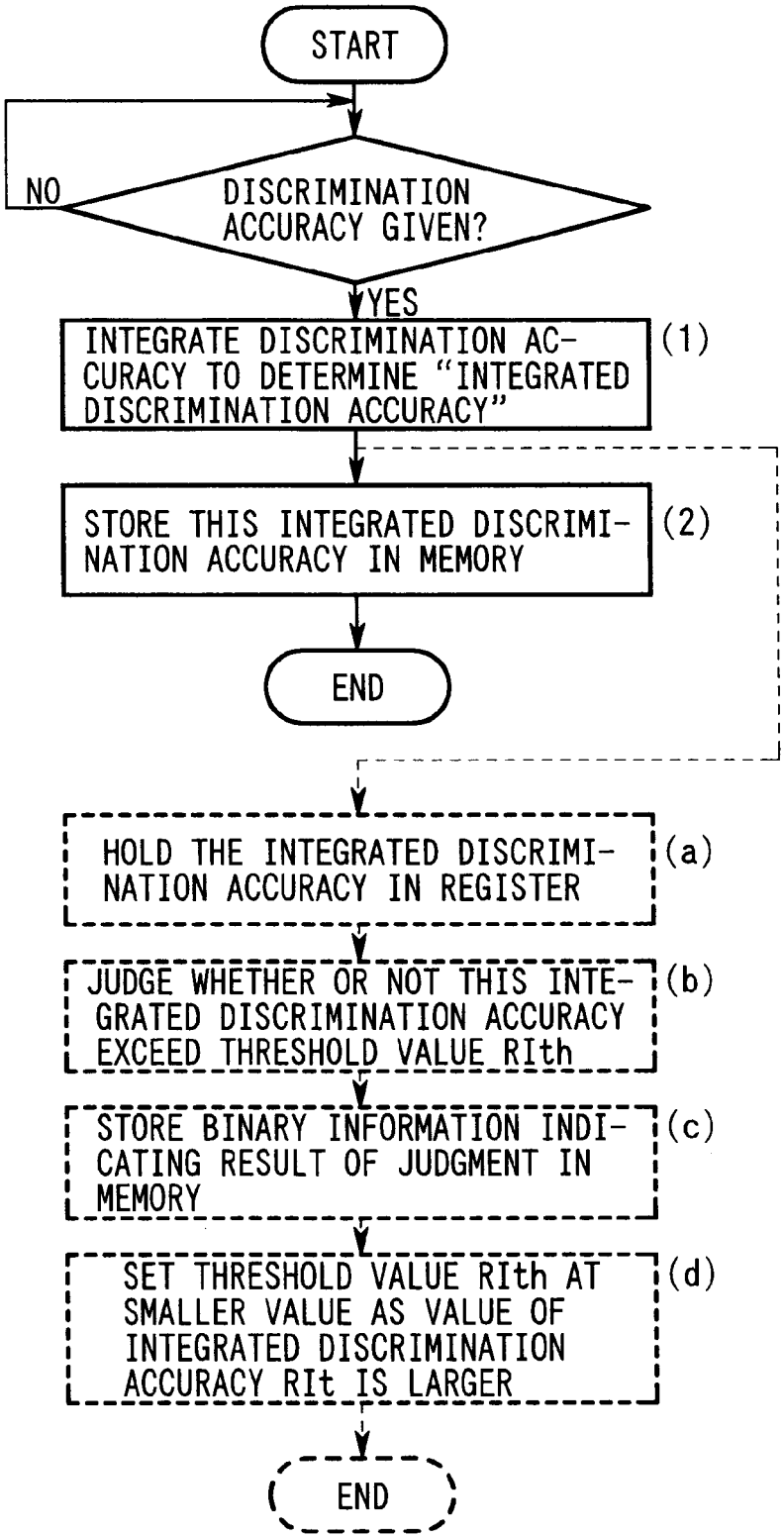
FIG. 11 is an operation flow chart of the embodiment 7 and the embodiment 8.

FIG. 11 is an operation flow chart of the embodiment 7 and the embodiment 8.

The operation of this embodiment is hereinafter explained with reference to FIG. 3, FIG. 5, and FIG. 11.

This embodiment is characterized by the procedure for the following processing performed by either one of the discrimination-accuracy determining parts 22 and 22A to 22D described above.

Note that only the discrimination-accuracy determining part 22 is hereinafter focused on out of the discrimination-accuracy determining parts 22 and 22A to 22D for simplification.

Even when new discrimination accuracy Rt is determined, the discrimination-accuracy determining part 22 does not store this discrimination accuracy Rt directly in the memory 23, but determines an integrated value (hereinafter, referred to as 'integrated discrimination accuracy RIt') which is obtained by integrating the discrimination accuracy Rt while weighting it with a predetermined weight in order of time sequence (FIG. 11(1)) to store this integrated discrimination accuracy RIt in the memory instead of the discrimination accuracy Rt (FIG. 11(2)).

In the process of the integration like the above, a component of steep fluctuation which may possibly accompany with the discrimination accuracy Rt obtained in order of time sequence is reduced or suppressed according to the weight applied to the aforesaid weighting.

Consequently, according to this embodiment, flexible adaptability to various noises which may possibly accompany with aural signals is made possible, and the application of the present invention to any of the embodiment 1 to the embodiment 6 realizes stabilization of performance.

Incidentally, neither the aforesaid weight nor a form of an arithmetic operation nor an algorithm realizing the integration is specified in this embodiment.

However, in the process of such an arithmetic operation, integration processing by any algorithm such as a moving average method, exponential smoothing, or others and by any weight may be executed for the discrimination accuracy Rt which is precedingly obtained for a predetermined number C.

Embodiment 8

The configuration of this embodiment is basically the same as those of the embodiment 1 to the embodiment 7 described above.

The operation of this embodiment is hereinafter explained with reference to FIG. 3, FIG. 5, and FIG. 11.

This embodiment. is characterized by the procedure for the following processing performed by the discrimination-accuracy determining parts 22 and 22A to 22D.

This embodiment is different from the embodiment 7 described above in that the discrimination-accuracy determining parts 22 and 22A to 22D perform the following processing.

Note that only the discrimination-accuracy determining part 22 is hereinafter focused on out of the discrimination-accuracy determining parts 22 and 22A to 22D for simplification.

Even when new integrated discrimination accuracy RIt is determined, the discrimination-accuracy determining part 22 does not directly store this integrated discrimination accuracy RIt in the memory 23.

The discrimination-accuracy determining part 22 holds the new integrated discrimination accuracy RIt, when it is determined, in a register (not shown) provided therein (FIG. 11(*a*)).

The discrimination-accuracy determining part 22 also judges whether or not this integrated discrimination accuracy RIt exceeds a later-described threshold value RIth (FIG. 11 (*b*)) and stores binary information RBt indicating the result of the judgment in the memory 23 instead of the integrated discrimination accuracy RIt (FIG. 11(*c*)).

The discrimination-accuracy determining part 22 further performs the following processing to determine the threshold value RIth to be applied to the same processing given to a subsequent active voice frame (FIG. 11(*d*)):

- to set it at a smaller value as avalue of the integrated discrimination accuracy RIt held in the aforesaid register is larger; and
- on the other hand, to set it at a larger value as a value of the integrated discrimination accuracy RIt is smaller.

In other words, a logical value of the binary information RBt to be given to the general determining part 24 or the discrimination condition adjusting part 31 via the memory 23 instead of the discrimination accuracy Rt and the integrated discrimination accuracy RIt is set at such a value to cause an active voice frame subsequently given to be discriminated as an active voice segment with higher probability, as the quality of an active voice frame precedingly given is higher or an hour rate when the quality is high is larger.

Consequently, according to this embodiment, deterioration in transmission quality which is caused because the active voice segment is discriminated as the non-active voice segrnent is avoided with high reliability compared with the embodiment 1 to the embodiment 7.

Incidentally, in each of the embodiments described hitherto all of the following values are binary information:

- the binary information "It" determined by the active voice/non-active voice discriminating parts 21 and 21A;
- either one of the binary discrimination accuracy Rt, the integrated discrimination accuracy RIt, and the binary information RIt determined by the discrimination-accuracy determining parts 22 and 22A to 22D; and
- the value of the binary signal given to the receiving/transmitting part 43 by the general determining part 24

However, these values may be given as multiple-value information, quantized instead of being judged to be larger than the threshold value or not, or weighted with an appropriate weight, as long as the aforesaid objects are achieved.

Furthermore, in each of the embodiments described above, the present invention is applied to a transmitting part of a radio transmission system.

However, the present invention is not limited to be applied to such a radio transmission system, and is similarly applicable to a transmitting part of a line transmission system or to various electronic equipments performing predetermined processing (including pattern recognition) and a predetermined operation in response to a voice.

The invention is not limited to the above embodiments and various modifications may be made without departing from the spirit and the scope of the invention. Any improvement may be made in part or all of the components.

What is claimed is:

1. A voice activity detecting device comprising:

a speech-segment inferring section for determining, for each of active voice frames as an aural signal given in order of time sequence, a probability that the active voice frame belongs to an active voice segment, the determining being made based on a statistical characteristic of the aural signal;

a quality monitoring section for monitoring quality of the aural signal for each of the active voice frames; and a speech-segment determining section for determining, for each of the active voice frames as an aural signal given in order of time sequence, an accuracy that the active voice frame belongs to an active voice segment by weighting the probability determined by said speech-segment inferring section with the quality monitored by said quality monitoring section.

2. A voice activity detecting device comprising:

a speech-segment determining section for determining, for each of active voice frames as an aural signal given in order of time sequence, an accuracy that the active voice frame belongs to an active voice segment, the determining being made based on a statistical characteristic of the aural signal; and a quality monitoring section for monitoring quality of the aural signal for each of the active voice frames, and wherein said speech-segment determining section weights a sequence of instantaneous values of the aural signal contained in each of the active voice frames by a weighting given as a monotone decreasing function or a monotone nonincreasing function of the quality monitored by said quality monitoring section.

3. A voice activity detecting device comprising:

a speech-segment determining section for determining an accuracy that individual active voice frames belong to an active voice segment by performing companding processing for each of the active voice frames given in order of time sequence and by analyzing, based on a statistical characteristic of an aural signal, a sequence of instantaneous values of the aural signal obtained in the companding processing; and a quality monitoring section for monitoring quality of the aural signal for each of the active voice frames, and wherein said speech-segment determining section applies a companding characteristic to the companding processing for each of the active voice frames, the companding characteristic being given as a monotone decreasing function of the quality monitored by said quality monitoring section.

4. The voice activity detecting device according to claim 1, wherein said quality monitoring section determines a feature of the active voice segment of the aural signal and/or a feature of the non-active voice segment of the aural signal to obtain the quality of the aural signal as one of the features or a difference between the features.

5. The voice activity detecting device according to claim 2, wherein said quality monitoring section determines a feature of the active voice segment of the aural signal and/or a feature of the non-active voice segment of the aural signal to obtain the quality of the aural signal as one of the features or a difference between the features.

6. The voice activity detecting device according to claim 3, wherein said quality monitoring section determines a feature of the active voice segment of the aural signal and/or a feature of the non-active voice segment of the aural signal to obtain the quality of the aural signal as one of the features or a difference between the features.

7. The voice activity detecting device according to claim 1, wherein said quality monitoring section determines assessed noise-power for each of the active voice frames to obtain the quality of the aural signal as a monotone nonincreasing function of the assessed noise-power.

8. The voice activity detecting device according to claim 2, wherein said quality monitoring section determines assessed noise-power for each of the active voice frames to obtain the quality of the aural signal as a monotone nonincreasing function of the assessed noise-power.

9. The voice activity detecting device according to claim 3, wherein said quality monitoring section determines assessed noise-power for each of the active voice frames to obtain the quality of the aural signal as a monotone nonincreasing function of the assessed noise-power.

10. The voice activity detecting device according to claim 1, wherein said quality monitoring section determines, for each of the active voice frames, assessed noise-power and an assessed value of an SN ratio to obtain the quality of the aural signal as a monotone nonincreasing function and a monotone nondecreasing function, respectively.

11. The voice activity detecting device according to claim 2, wherein said quality monitoring section determines, for each of the active voice frames, assessed noise-power and an assessed value of an SN ratio to obtain the quality of the aural signal as a monotone nonincreasing function and a monotone nondecreasing function, respectively.

12. The voice activity detecting device according to claim 3, wherein said quality monitoring section determines, for each of the active voice frames, assessed noise-power and an assessed value of an SN ratio to obtain the quality of the aural signal as a monotone nonincreasing function and a monotone nondecreasing function, respectively.

13. The voice activity detecting device according to claim 1, wherein said quality monitoring section determines a standardized random variable for each of the active voice frames to obtain the quality of the aural signal as a monotone decreasing function of the standardized random variable.

14. The voice activity detecting device according to claim 2, wherein said quality monitoring section determines a standardized random variable for each of the active voice frames to obtain the quality of the aural signal as a monotone decreasing function of the standardized random variable.

15. The voice activity detecting device according to claim 3, wherein said quality monitoring section determines a standardized random variable for each of the active voice frames to obtain the quality of the aural signal as a monotone decreasing function of the standardized random variable.

16. The voice activity detecting device according to claim 1, wherein said quality monitoring section determines, for each of the active voice frames, a standardized random variable and an assessed value of an SN ratio to obtain the quality of the aural signal as a monotone nonincreasing function and a monotone nondecreasing function, respectively.

17. The voice activity detecting device according to claim 2, wherein said quality monitoring section determines, for each of the active voice frames, a standardized random variable and an assessed value of an SN ratio to obtain the quality of the aural signal as a monotone nonincreasing function and a monotone nondecreasing function, respectively.

18. The voice activity detecting device according to claim 3, wherein said quality monitoring section determines, for each of the active voice frames, a standardized random variable and an assessed value of an SN ratio to obtain the quality of the aural signal as a monotone nonincreasing function and a monotone nondecreasing function, respectively.

19. The voice activity detecting device according to claim 7, wherein said quality monitoring section determines a peak value of instantaneous values of the aural signal contained in each of the active voice frames; and calculates amplitude normalized by a standard deviation of the probability density function by applying, to a probability density function approximating to amplitude distribution of the aural signal, the number of the instantaneous values and a probability at which the peak value appears; and determines a standardized random variable as a ratio of the amplitude to the peak value.

20. The voice activity detecting device according to claim 8, wherein said quality monitoring section determines a peak value of instantaneous values of the aural signal contained in each of the active voice frames; and calculates amplitude normalized by a standard deviation of the probability density function by applying, to a probability density function approximating to amplitude distribution of the aural signal, the number of the instantaneous values and a probability at which the peak value appears; and determines a standardized random variable as a ratio of the amplitude to the peak value.

21. The voice activity detecting device according to claim 9, wherein said quality monitoring section determines a peak value of instantaneous values of the aural signal contained in each of the active voice frames; and calculates amplitude normalized by a standard deviation of the probability density function by applying, to a probability density function approximating to amplitude distribution of the aural signal, the number of the instantaneous values and a probability at which the peak value appears; and determines a standardized random variable as a ratio of the amplitude to the peak value.

22. The voice activity detecting device according to claim 10, wherein said quality monitoring section determines a peak value of instantaneous values of the aural signal contained in each of the active voice frames; and calculates amplitude normalized by a standard deviation of the probability density function by applying, to a probability density function approximating to amplitude distribution of the aural signal, the number of the instantaneous values and a probability at which the peak value appears; and determines a standardized random variable as a ratio of the amplitude to the peak value.

23. The voice activity detecting device according to claim 11 , wherein said quality monitoring section determines a peak value of instantaneous values of the aural signal contained in each of the active voice frames; and calculates amplitude normalized by a standard deviation of the probability density function by applying, to a probability density function approximating to amplitude distribution of the aural signal, the number of the instantaneous values and a probability at which the peak value appears; and determines a standardized random variable as a ratio of the amplitude to the peak value.

24. The voice activity detecting device according to claim 12, wherein said quality monitoring section determines a peak value of instantaneous values of the aural signal contained in each of the active voice frames; and calculates amplitude normalized by a standard deviation of the probability density function by applying, to a probability density function approximating to amplitude distribution of the aural signal, the number of the instantaneous values and a probability at which the peak value appears; and determines a standardized random variable as a ratio of the amplitude to the peak value.

25. The voice activity detecting device according to claim 1, wherein said quality monitoring section integrates the monitored quality of the aural signal in sequence to apply the resultant as normal quality.

26. The voice activity detecting device according to claim 2, wherein said quality monitoring section integrates the monitored quality of the aural signal in sequence to apply the resultant as normal quality.

27. The voice activity detecting device according to claim 3, wherein said quality monitoring section integrates the monitored quality of the aural signal in sequence to apply the resultant as normal quality.

28. The voice activity detecting device according to claim 1, wherein said quality monitoring section integrates the monitored quality of the aural signal in sequence to apply as quality a value which is obtained as a monotone increasing function or a monotone nondecreasing function of the resultant.

29. The voice activity detecting device according to claim 2, wherein said quality monitoring section integrates the monitored quality of the aural signal in sequence to apply as quality avalue which is obtained as a monotone increasing function or a monotone nondecreasing function of the resultant.

30. The voice activity detecting device according to claim 3, wherein said quality monitoring section integrates the monitored quality of the aural signal in sequence to apply as quality a value which is obtained as a monotone increasing function or a monotone nondecreasing function of the resultant.

31. A voice activity detecting method comprising the steps of:

determining, for each of active voice frames as an aural signal given in order of time sequence, a probability that the active voice frame belongs to an active voice segment, the determining being made based on a statistical characteristic of the aural signal;

monitoring quality of the aural signal for each of the active voice frames; and determining, for each of the active voice frames as an aural signal given in order of time sequence, an accuracy that the active voice frame belongs to an active voice segment by weighting the determined probability with the monitored quality.

32. A voice activity detecting method comprising the steps of:

determining, for each of the active voice frames as an aural signal given in order of time sequence, an accuracy that the active voice frame belongs to an active voice segment, the determining being made based on a statistical characteristic of the aural signal;

monitoring quality of the aural signals for each of the active voice frames; and weighting a sequence of instantaneous values of the aural signal contained in each of the active voice frames. by a weighting given as a monotone decreasing function or a monotone nonincreasing function of the monitored quality.

33. A voice activity detecting method comprising the steps of:

determining an accuracy that individual active voice frames belong to an active voice segment by performing companding processing for each of the active voice frames as an aural signal given in order of time sequence and by analyzing a sequence of instantaneous values of an aural signal obtained in the companding processing, the determining being made based on a statistical characteristic of the aural signal;

monitoring quality of the aural signal for each of the active voice frames; and applying a companding characteristic to the companding processing for each of the active voice frames, the companding characteristic being given as a monotone decreasing function of the monitored quality.

* * * * *